US011592250B2

(12) United States Patent
No

(10) Patent No.: US 11,592,250 B2
(45) Date of Patent: Feb. 28, 2023

(54) MAGAZINE

(71) Applicant: Tae Jong No, Paju-si (KR)

(72) Inventor: Tae Jong No, Paju-si (KR)

( * ) Notice: Subject to any disclaimer, the term of this patent is extended or adjusted under 35 U.S.C. 154(b) by 0 days.

(21) Appl. No.: 17/340,324

(22) Filed: Jun. 7, 2021

(65) Prior Publication Data

US 2022/0244006 A1 Aug. 4, 2022

(30) Foreign Application Priority Data

Jan. 29, 2021 (KR) ..... 10-2021-0013340

(51) Int. Cl.
*F41A 9/70* (2006.01)

(52) U.S. Cl.
CPC ..... *F41A 9/70* (2013.01)

(58) Field of Classification Search
CPC ..... F41A 9/70
USPC ..... 42/50
See application file for complete search history.

(56) References Cited

U.S. PATENT DOCUMENTS

| | | | | |
|---|---|---|---|---|
| 10,066,886 | B2 * | 9/2018 | Vilardi | F41A 9/69 |
| 10,247,498 | B2 * | 4/2019 | McCormick | F41A 9/70 |
| 11,280,569 | B2 * | 3/2022 | Yeates | F41A 9/65 |
| 2016/0209140 | A1 * | 7/2016 | Toth | F41A 9/65 |

FOREIGN PATENT DOCUMENTS

KR 10-1154114 A 6/2012

* cited by examiner

*Primary Examiner* — Reginald S Tillman, Jr.
(74) *Attorney, Agent, or Firm* — Goldilocks Zone IP Law

(57) ABSTRACT

Proposed is a magazine having a magazine body of which the upper portion is not deformed by high-temperature heat that is generated at the moment that a bullet is fired. The magazine includes: a magazine body that is made of synthetic resin, has front and rear plates and two side plates, a cartridge outlet formed at a top thereof, a front groove being open upward and formed at a top of the front plate, and a rear groove being open upward and formed at a top of the rear plate, and has guide plates bent toward the inside of the cartridge outlet at rear portions of top of the side plates and preventing cartridges from separating upward; two side reinforcing metal plates inserted and fixed by insert molding inside upper portions of the side plates and the guide plates not to be exposed to the outside.

5 Claims, 11 Drawing Sheets

[FIG. 1A]
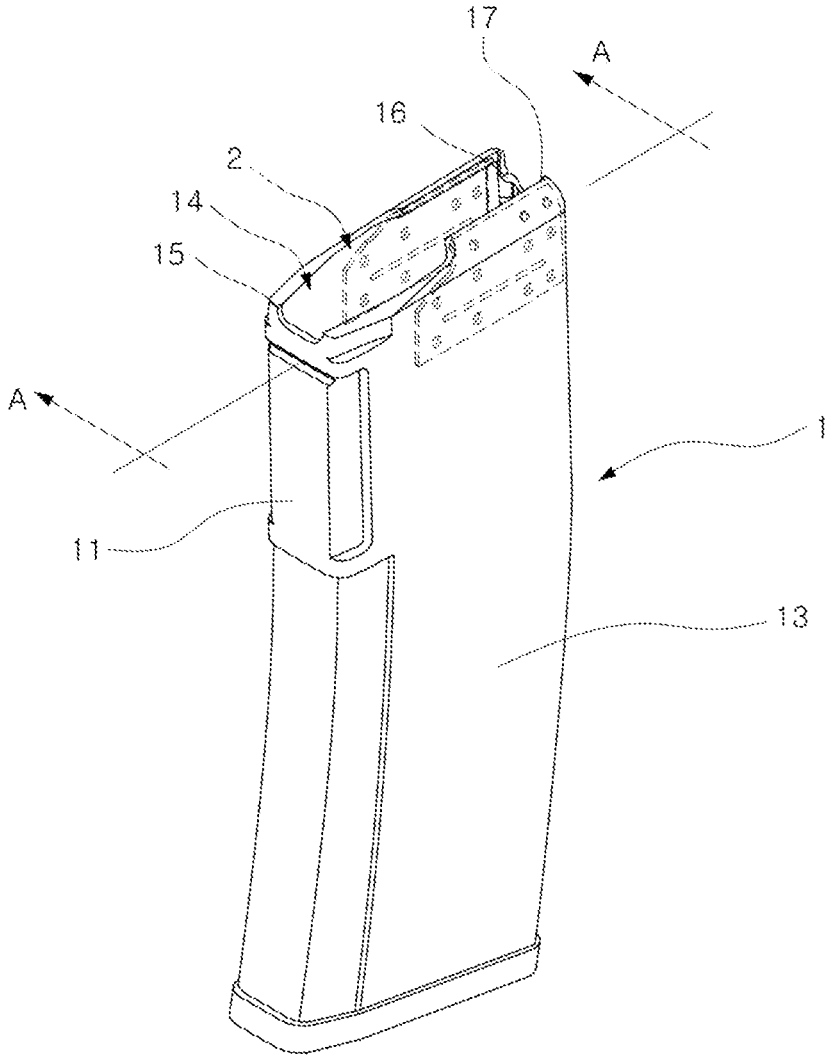

[FIG. 1B]
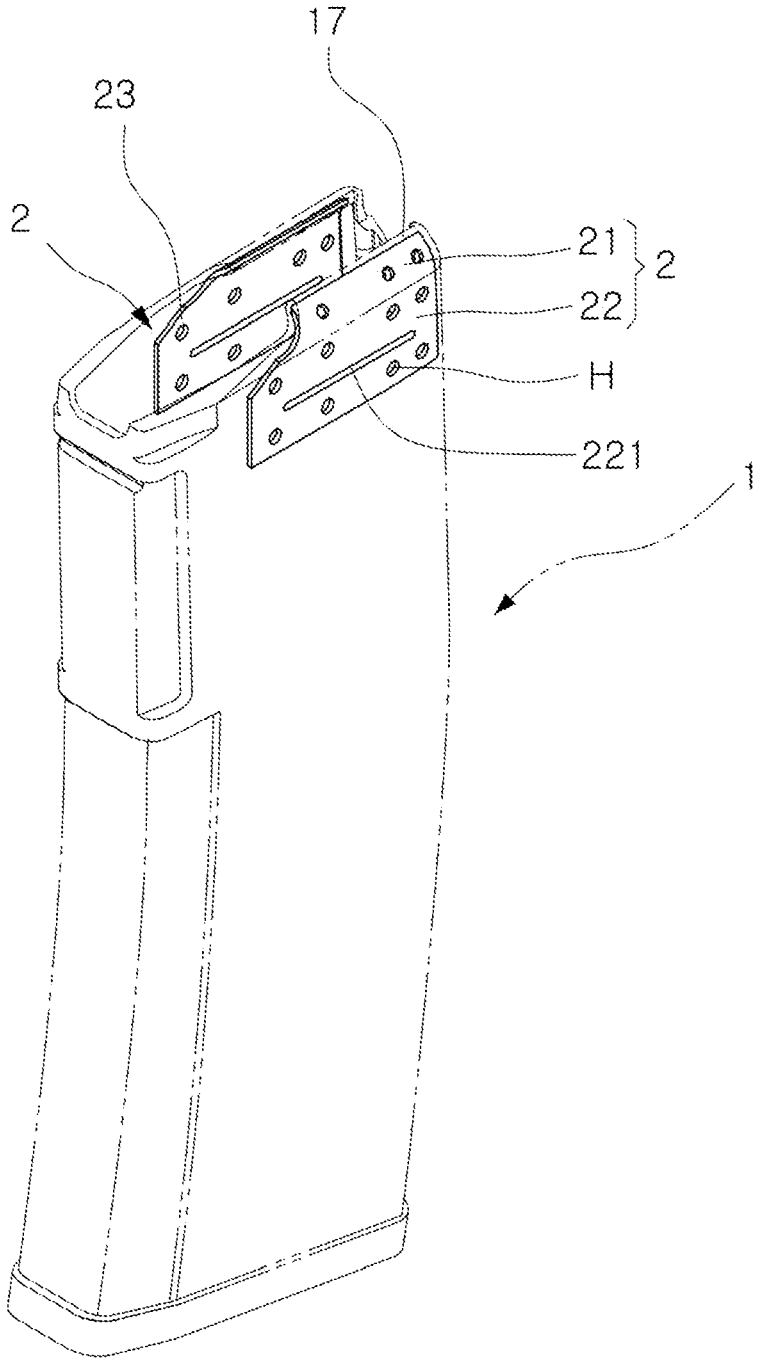

[FIG. 2]
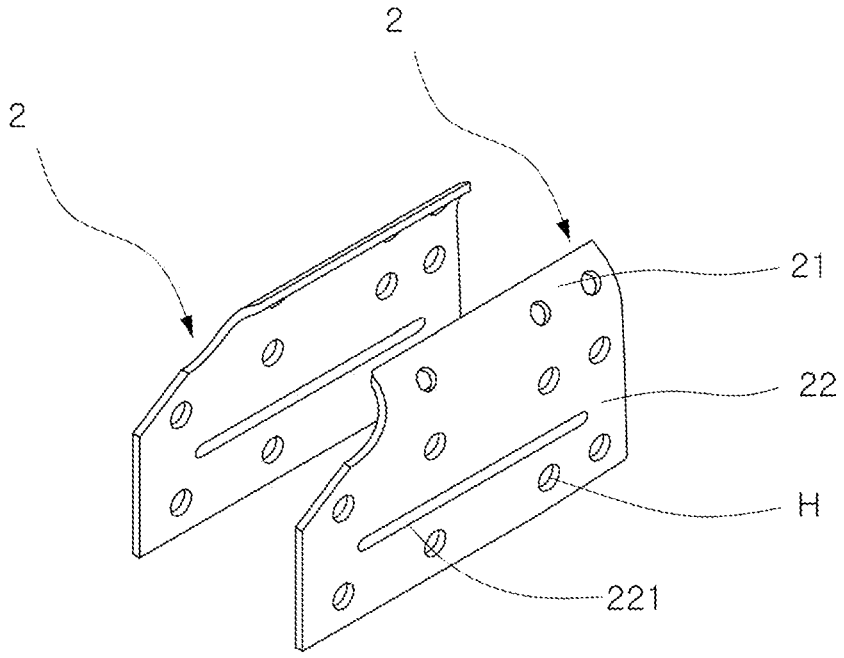
[FIG. 3]
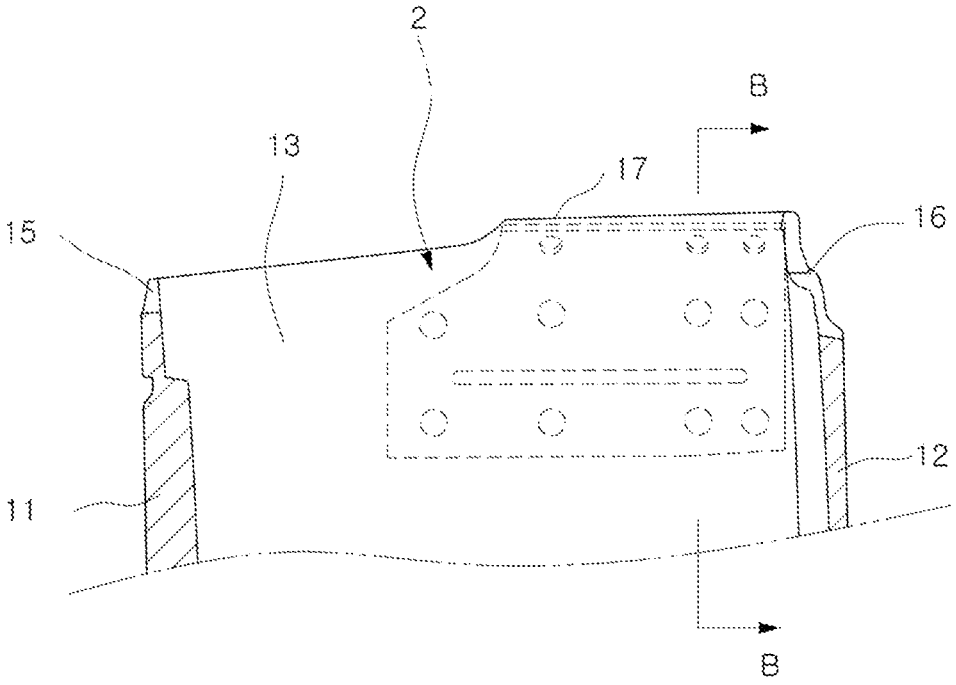

[FIG. 4]
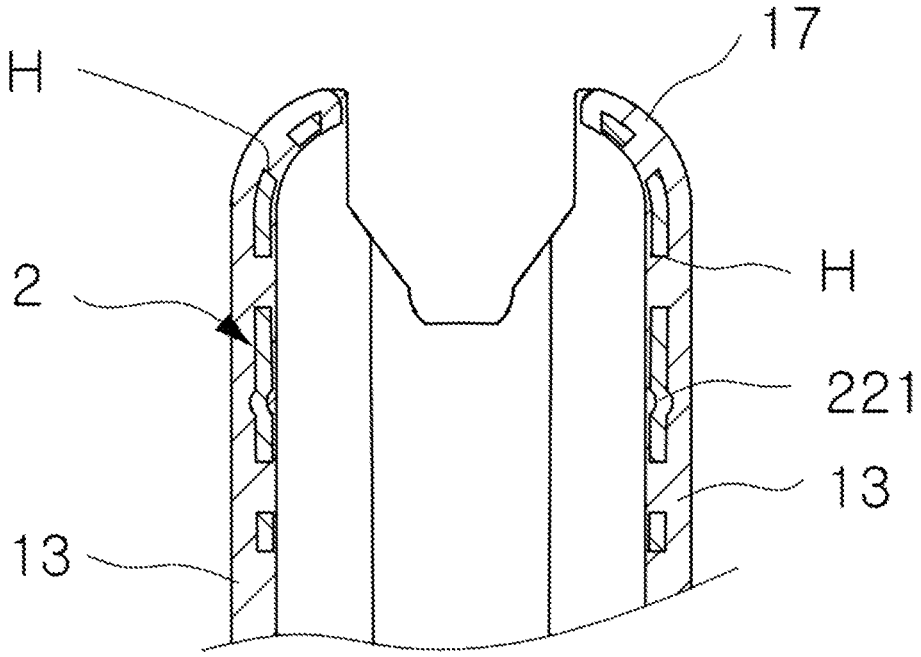

[FIG. 5A]
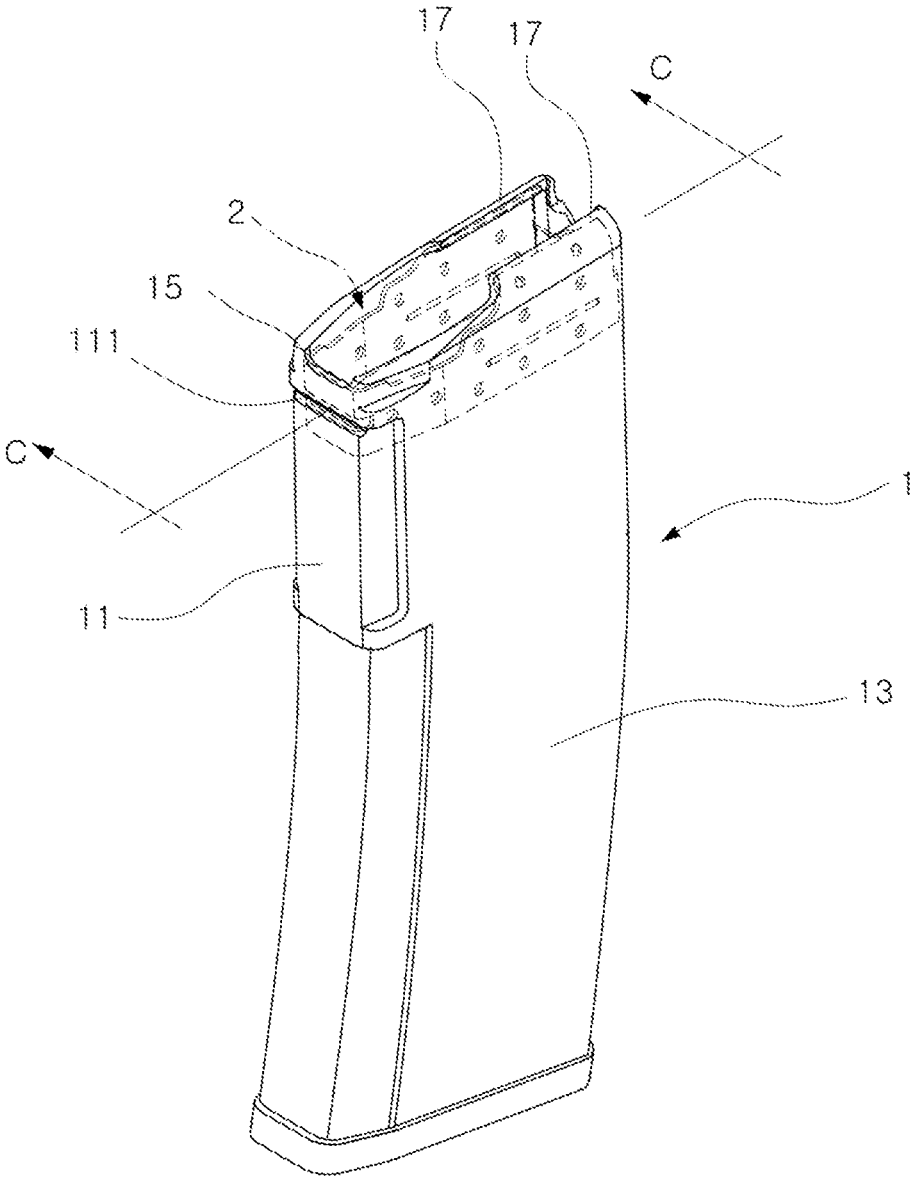

[FIG. 5B]
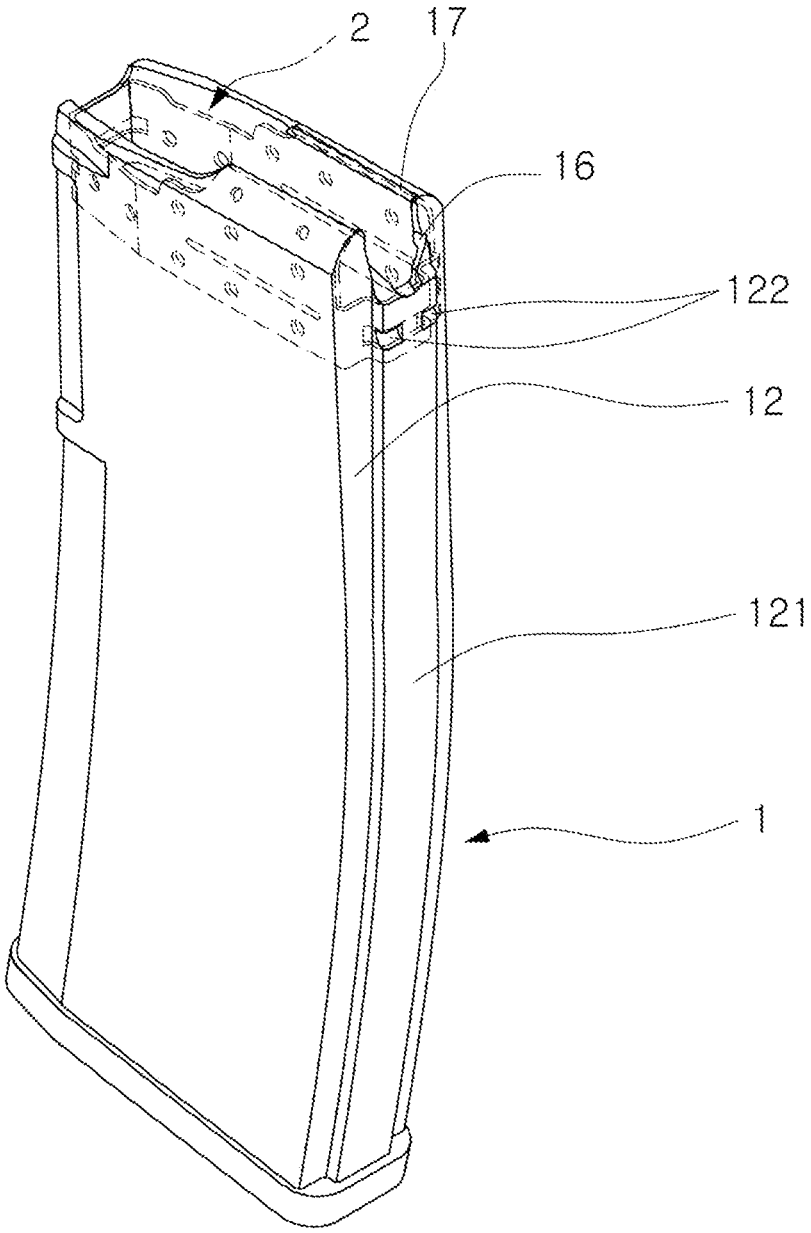

[FIG. 5C]
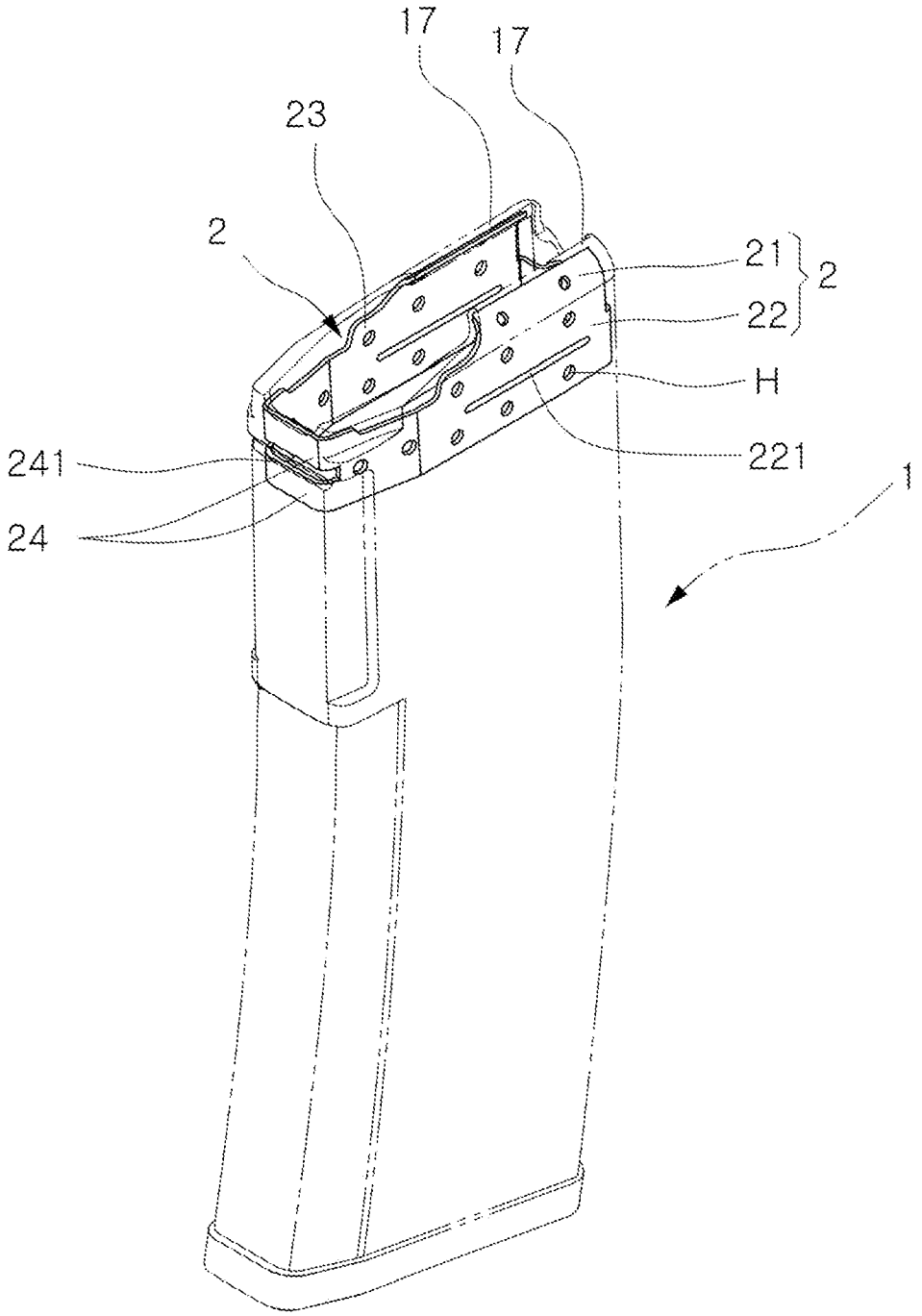

[FIG. 6A]
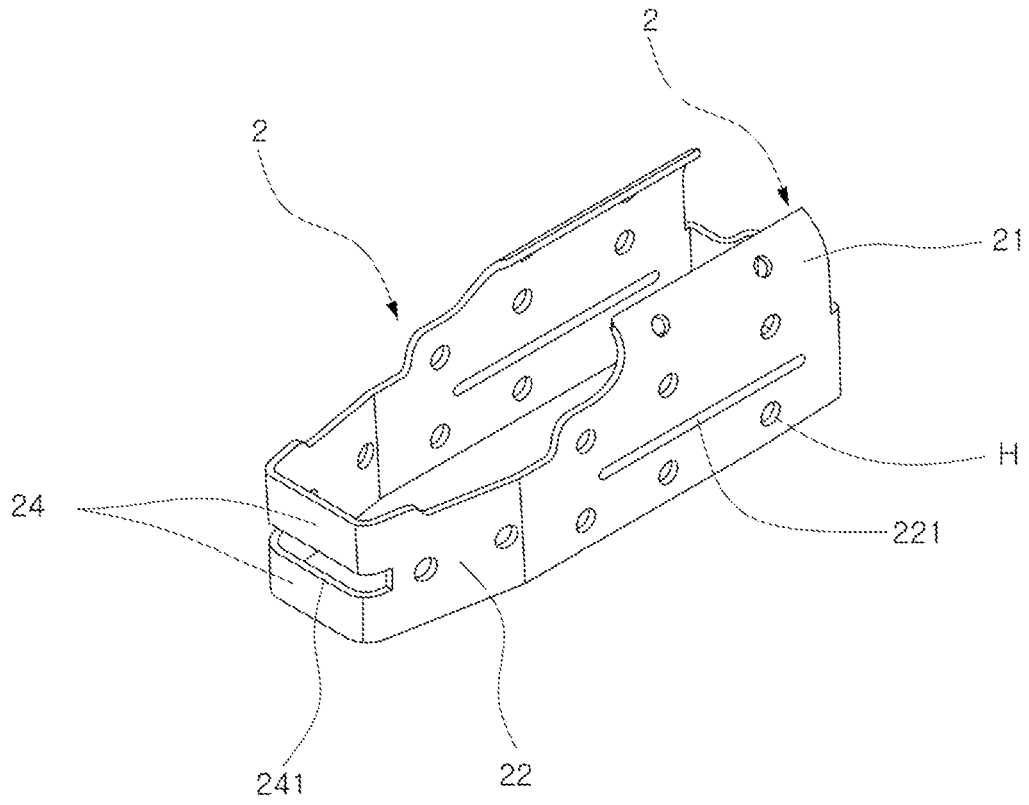

[FIG. 6B]
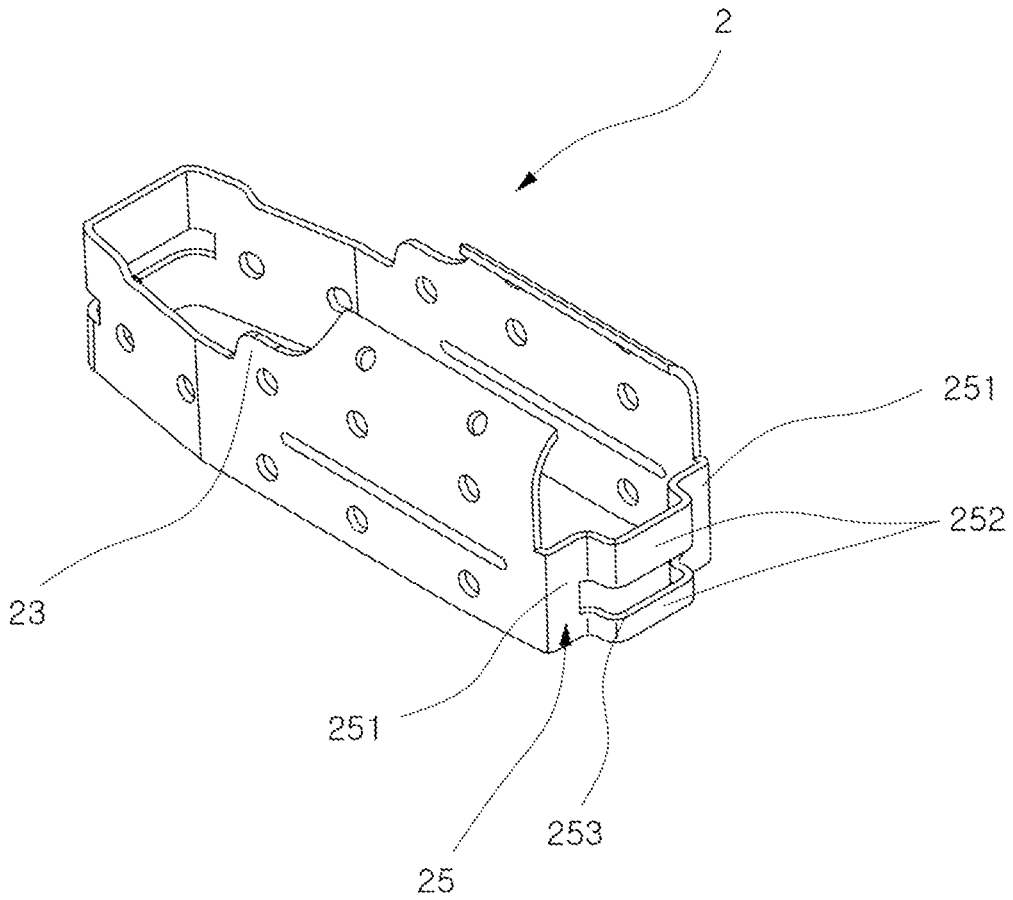

[FIG. 7]
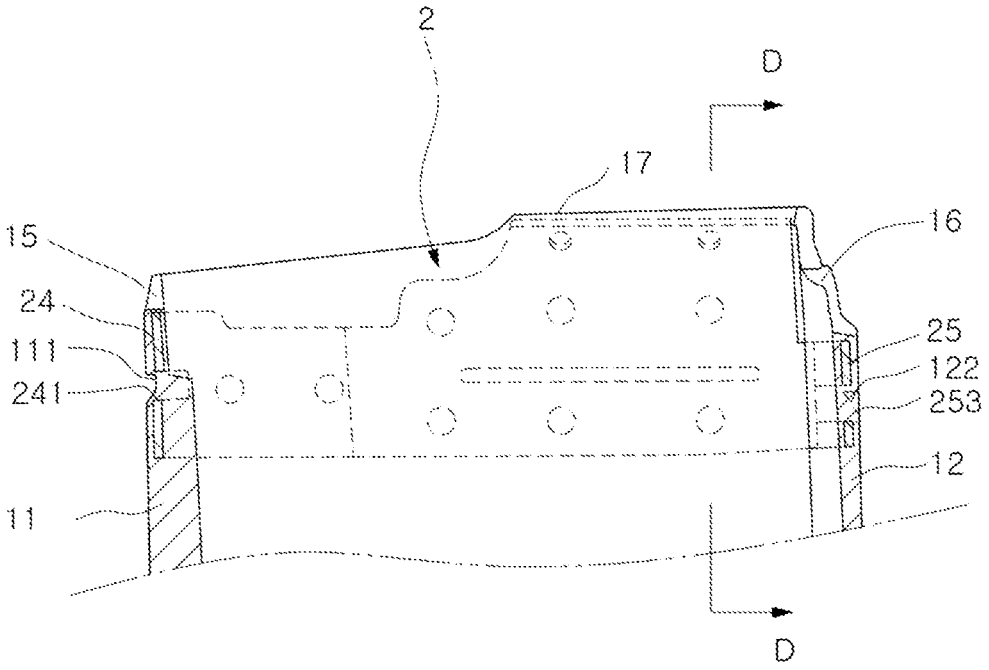

[FIG. 8]
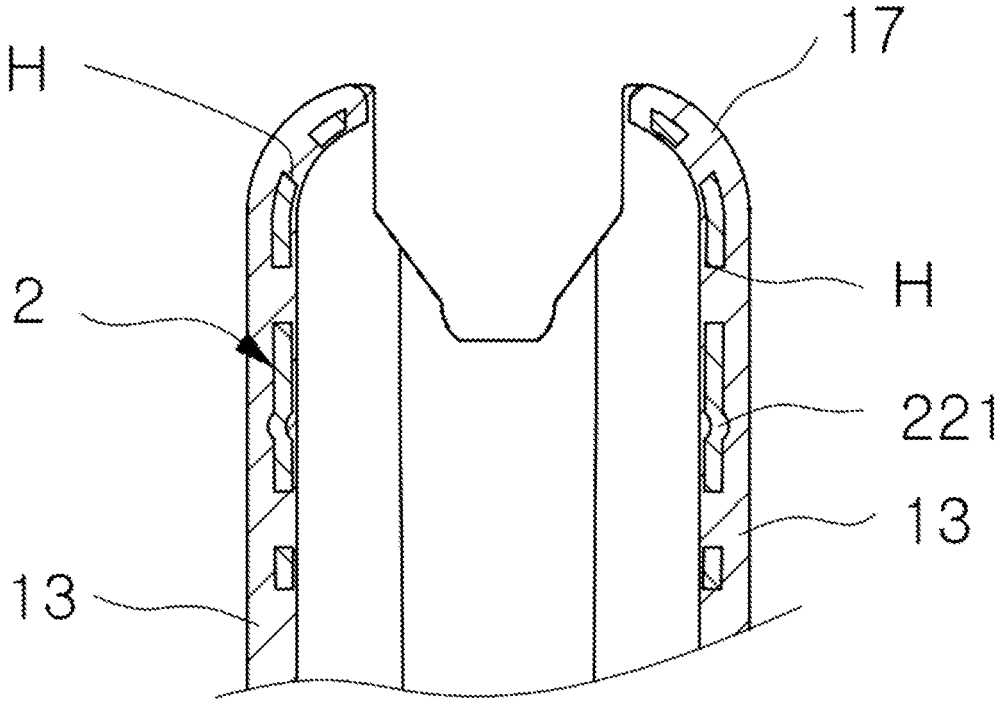

MAGAZINE

CROSS REFERENCE TO RELATED APPLICATION

The present application claims priority to Korean Patent Application No. 10-2021-0013340, filed Jan. 29, 2021, the entire contents of which is incorporated herein for all purposes by this reference.

BACKGROUND OF THE INVENTION

Field of the Invention

The present disclosure relates to a magazine and, more particularly, to a magazine having a magazine body of which the upper portion is not deformed by high-temperature heat that is generated at the moment that a bullet is fired.

Description of the Related Art

In general, a magazine, which is a container that holds cartridges such as ball cartridges or blank cartridges, is fundamentally loaded with cartridges to load a riffle or to carry the cartridges. A box-type magazine in which cartridges are straightly loaded and a drum-type magazine in which cartridges are spirally loaded are generally used.

Box-type magazines made of synthetic resin to reduce the weight the magazines are generally used in the related art.

As an example of the box-type magazines of the related art, a "plastic magazine" (hereafter, referred to a "plastic magazine of an embodiment in the related art") has been disclosed in Korean patent No. 10-1154114.

A plastic magazine of an embodiment in the related art has a plurality of sides that are made of plastic and along which cartridges are moved to reload a firearm. The sides include a front wall that is positioned in the firing direction, the inner surface of the front wall is covered with a spring steel cover plate, and the front wall has a groove.

When the plastic magazine of an embodiment having this configuration in the related art is loaded with cartridges and is inserted in a magazine seat of a riffle and then the riffle is fired, a cartridge case is separated by a breechblock at the moment of firing and high-temperature heat is generated due to hitting by a firing pin at the moment that a bullet is fired. Accordingly, when the plastic magazine is used for a long period of time, the portion for discharging cartridges which is the open upper portion of the magazine is deformed by high-temperature heat.

That is, when the plastic magazine of an embodiment in the related art is used for a long period of time, the insertion portion of the magazine is deformed by heat, so there is a problem that the magazine is not easily inserted into the cartridge seat of a riffle or is not easily pulled out of the cartridge seat.

Further, when the plastic magazine of an embodiment in the related art is used for long period of time, the insertion portion of the magazine is deformed, so there is a problem that accidental firing accidents of riffles frequently occur.

Further, there is a plastic magazine in which a surrounding metal plate is attached and fixed to the outer surface of the upper portion thereof or a surrounding metal plate is bent and fixed to the outer surface of the upper portion thereof in the related art (hereafter, referred to as a "plastic magazine of another embodiment in the related art").

However, in order to manufacture the plastic magazine of another embodiment in the related art, an additional process of further attaching or bending and fixing a surrounding metal plate to the outer surface of the upper portion of the magazine is further performed. Therefore, there is a problem that productivity of the magazine is deteriorated and the manufacturing cost is increased by the post-process of attaching or bending and fixing a surrounding metal plate.

Further, when the plastic magazine of another embodiment in the related art is loaded with cartridges and is inserted in a magazine seat of a riffle and then the riffle is fired, a cartridge case is separated by a breechblock at the moment of firing and high-temperature heat is generated due to hitting by a firing pin at the moment that a bullet is fired. Accordingly, when the plastic magazine is used for a long period of time, the portion for discharging cartridges which is the open upper portion of the magazine is deformed by high-temperature heat.

Accordingly, since the portion for discharging cartridges which is the open upper portion of the plastic magazine of another embodiment in the related art is deformed by high-temperature heat when a bullet is fired from the magazine, there is also a problem that a malfunction of separation of the surrounding metal plate fixed to the insertion portion of the magazine frequently occurs.

DOCUMENTS OF RELATED ART (Patent Document 1) Korean Patent No. 10-1154114, "Plastic magazine"

SUMMARY OF THE INVENTION

The present disclosure has been made in an effort to solve the general problems of the related art described above and an objective of the present disclosure is to provide a magazine having a magazine body of which the upper portion is not deformed by high-temperature heat that is generated at the moment that a bullet is fired even though the magazine is used for a long period of time because reinforcing metal plates are inserted and fixed by insert molding inside the upper portion of the magazine body made of synthetic resin not to be exposed to the outside.

In order to achieve the objectives of the present disclosure, a magazine includes: a magazine body that is made of synthetic resin, has front and rear plates and two side plates, a cartridge outlet formed at a top thereof, a front groove being open upward and formed at a top of the front plate, and a rear groove being open upward and formed at a top of the rear plate, and has guide plates bent toward the inside of the cartridge outlet at rear portions of top of the side plates and preventing cartridges from separating upward; two side reinforcing metal plates inserted and fixed by insert molding inside upper portions of the side plates and the guide plates not to be exposed to the outside.

In the magazine according to the present disclosure, several resin holes filled with the synthetic resin for forming the magazine body may be further formed in the reinforcing metal plates.

In the magazine according to the present disclosure, the reinforcing metal plates each may have: a guide plate reinforcement part inserted and fixed inside the guide plate; and a transverse body upper-portion reinforcement part integrally connected to a bottom of the guide plate reinforcement part, and elongated and partially or entirely inserted and fixed in a left-right direction inside the upper portion of the side plate.

According to the present disclosure having the configuration described above, since the reinforcing metal plates are inserted and fixed by insert molding inside the upper portion of the magazine body made of synthetic resin not to be exposed to the outside, the deformation of the upper portion of the magazine body due to high-temperature heat, which is generated at the moment that a bullet is fired, is prevented even though a long period of time passes. Accordingly, there is an effect that the magazine can be easily inserted into and pulled out of the magazine seat of a riffle even though the magazine is used for a long period of time and there is another effect that a malfunction of separation of the reinforcing metal plates can be prevented even though the magazine is used for a long period of time.

Further, since deformation of the upper portion of the magazine body due to high-temperature heat that is generated when a bullet is fired, even though a long period of time passes, there is an effect that a magazine improved in safety and being able to prevent an accidental firing accident when a riffle is fired is provided.

Further, since the reinforcing metal plates are simply inserted and fixed inside the upper portion of the magazine body by insert molding, there is no need for a separate process of fixing reinforcing metal plates, so there is an effect that it is possible to provide a magazine of which the productivity can be improved and the manufacturing cost can also be reduced.

BRIEF DESCRIPTION OF THE DRAWINGS

The above and other objectives, features and other advantages of the present disclosure will be more clearly understood from the following detailed description when taken in conjunction with the accompanying drawings, in which:

FIG. 1A is a front perspective view showing a magazine according to an embodiment of the present disclosure;

FIG. 1B is a perspective view showing reinforcing metal plates in the magazine according to an embodiment of the present disclosure;

FIG. 2 is a perspective view showing the reinforcing metal plates constituting the magazine according to an embodiment of the present disclosure;

FIG. 3 is a cross-sectional view taken along line A-A of FIG. 1A;

FIG. 4 is a cross-sectional view taken along line B-B of FIG. 3;

FIG. 5A is a front perspective view showing a magazine according to another embodiment of the present disclosure;

FIG. 5B is a rear perspective view showing the magazine according to another embodiment of the present disclosure;

FIG. 5C is a perspective view showing reinforcing metal plates in the magazine according to another embodiment of the present disclosure;

FIG. 6A is a front perspective view showing the reinforcing metal plates constituting the magazine according to another embodiment of the present disclosure;

FIG. 6B is a rear perspective view showing the reinforcing metal plates constituting the magazine according to another embodiment of the present disclosure;

FIG. 7 is a cross-sectional view taken along line C-C of FIG. 5A; and

FIG. 8 is a cross-sectional view taken along line D-D of FIG. 7.

DETAILED DESCRIPTION OF THE INVENTION

Exemplary embodiments of the present disclosure are described hereafter in more detail with reference to the accompanying drawings. However, it should be understood that the present disclosure may be achieved in several different ways and is not limited to the embodiments described herein.

FIG. 1A is a front perspective view showing a magazine according to an embodiment of the present disclosure, FIG. 1B is a perspective view showing reinforcing metal plates in the magazine according to an embodiment of the present disclosure, FIG. 2 is a perspective view showing the reinforcing metal plates constituting the magazine according to an embodiment of the present disclosure, FIG. 3 is a cross-sectional view taken along line A-A of FIG. 1A, and FIG. 4 is a cross-sectional view taken along line B-B of FIG. 3.

As shown in the figures, a magazine according to an embodiment of the present disclosure has been designed such that a insertion portion of the magazine which is the upper portion thereof is not deformed due to high-temperature heat that is generated when a bullet is fired because reinforcing metal plates are inserted and fixed by insert molding in the upper portion of a magazine body made of synthetic resin not to be exposed to the outside. The magazine includes a magazine body 1 and reinforcing metal plates.

The magazine body 1 is made of a transparent or opaque synthetic resin material and has front and rear plates 11 and 12 and two side plates 13. A cartridge outlet 14 is formed at the top of the magazine body 1, a front groove 15 being open upward is formed at the top of the front plate 11, and a rear groove 16 being open upward is formed at the top of the rear plate 12. A guide plate 17 that guides cartridges (not shown) while preventing the cartridges from separating upward is bent toward the inside of the cartridge outlet 14 at the rear portion of the top of each of the side plates 13.

The guide plate 17 may protrude inward in a quadrant arc shape so that the outer surface of a cartridge having a circular outer surface can come in close contact with the guide plate 17. Further, the guide plate 17 may integrally protrude inward at the top of the side plates 13 of the magazine body 1.

The magazine has a bottom plate (not shown) at the lower portion and a cartridge bed (not shown) that supports and pushes cartridges upward using elasticity of a spring may be disposed in the magazine.

The reinforcing metal plates 2 are inserted and fixed by insert molding inside the upper portions of the side plates 13 and the guide plates 17 not to be exposed to the outside, and two reinforcing metal plates 2 are provided.

In order to be able to prevent the upper portion of the magazine from being deformed by heat that is generated when a bullet is fired, the reinforcing metal plates 2 each may include a guide plate reinforcement part 21 inserted and fixed inside the guide plate 17, and a transverse body upper-portion reinforcement part 22 integrally connected to the bottom of the guide plate reinforcement part 21, and elongated, inserted, and fixed in the left-right direction inside the upper portion of the side plate 13. The body upper-portion reinforcement part 22, which is partially inserted and fixed inside the side plate 13, may be formed such that the front end protrudes forward further than the guide plate reinforcement part 21 and the rear end is formed under the end of the guide plate reinforcement part 21 to be able to improve a reinforcing force.

A reinforcing protrusion 221 bending to horizontally protrude outward may be further formed on the body upper-portion reinforcement part 22 to be able to reinforce the body upper-portion reinforcement part 22.

Each of the reinforcing metal plates 2 may further have a reinforcing corner plate 23 integrally connecting the front lower portion of the guide plate 17 and the top of the body upper-portion reinforcement part 22 to be able to further reinforce the portion between the front lower portion of the guide plate reinforcement part 21 and the upper end of the body upper-portion reinforcement part 22. Each of the reinforcing metal plates 2 may be made of a metal material that has high heat resistance and is not easily deformed even by high-temperature heat, and particularly, may be made of spring steel.

Each of the reinforcing metal plates 2 may further have several resin holes H that are filled with synthetic resin, which is the material of the magazine body 1, in injection molding of the magazine body 1 so that the reinforcing metal plates 2 can be more firmly fixed to the upper portion of the magazine body 1.

Hereafter, a use state and the manufacturing process of an embodiment having this configuration of the present disclosure are described.

As shown in FIGS. 1A to 4, in order to use the magazine having the configuration according to an embodiment of the present disclosure, a user fills the magazine with cartridges and then inserts the magazine filled with the cartridges into a magazine seat (not shown) of a riffle (not shown).

Next, the user fires bullets by pulling the trigger of the riffle. When a bullet is fired, a cartridge case is separated by a breechblock and high-temperature heat is generated at the upper portion of the magazine at the moment that the bullet is fired due to hitting of a firing pin.

The high-temperature heat generated at the moment that the bullet is fired concentrates on the open upper portion of the magazine. However, since the reinforcing metal plates 2 that are not deformed even by high-temperature heat are disposed inside the upper portion of the magazine, the upper portion of the magazine is not deformed. That is, since the reinforcing metal plates 2 are inserted and fixed by insert molding inside the upper portion of the magazine body 1 made of synthetic resin not to be exposed to the outside, the deformation of the upper portion of the magazine body 1 due to high-temperature heat, which is generated at the moment that a bullet is fired, is prevented even though a long period of time passes.

Accordingly, since deformation of the upper portion of the magazine body of the magazine according to an embodiment of the present disclosure due to high-temperature heat that is generated when a bullet is fired is prevented, there is an advantage that the magazine can be easily inserted into and pulled out of the magazine seat of a riffle even though the magazine is used for a long period of time. There is another advantage that a malfunction of separation of the reinforcing metal plates 2 can be prevented even though the magazine is used for a long period of time.

Further, according to the magazine of an embodiment of the present disclosure, since deformation of the upper portion of the magazine body due to high-temperature heat that is generated when a bullet is fired, even though a long period of time passes, there is an advantage that a magazine improved in safety and being able to prevent an accidental firing accident when a riffle is fired is provided.

Further, since the reinforcing metal plates 2 are formed inside the upper portions of both sides of the magazine of an embodiment according to the present disclosure by insert molding in the process of manufacturing the magazine through injection molding, two reinforcing metal plates 2 can be inserted and fixed inside the upper portions of the side plates 13 of the magazine body 1 and the guide plates 17 not to be exposed to the outside. Therefore, according to the magazine of an embodiment according to the present disclosure, since the reinforcing metal plates 2 are simply inserted and fixed by insert molding inside the upper portion of the magazine body 1, there is an advantage that it is possible to provide a magazine of which the productivity can be improved and the manufacturing cost can also be reduced.

FIGS. 5A, 5B, and 5C are views showing a magazine according to another embodiment of the present disclosure, FIGS. 6A and 6B are views showing reinforcing metal plates of the magazine according to another embodiment of the present disclosure, FIG. 7 is a cross-sectional view taken along line C-C of FIG. 5A, and FIG. 8 is a cross-sectional view taken along line D-D of FIG. 7.

As shown in FIGS. 5A to 8, it is assumed that a magazine according to another embodiment of the present disclosure includes all other components of the magazine according to the previous embodiment except the body upper-portion reinforcement parts 22 of the reinforcing metal plates 2.

Accordingly, in the magazine according to another embodiment of the present disclosure, the body upper-portion reinforcement parts 22 are integrally connected to the bottom of the guide plate reinforcement parts 21 and entirely elongated, inserted, and fixed in the left-right direction inside the upper portions of the side plates 13.

Each of the reinforcing metal plates 2 having the body upper-portion reinforcement part 22 entirely elongated, inserted, and fixed in the left-right direction inside the upper portion of the side plate 13 may further have several resin holes H that are filled with synthetic resin, which is the material of the magazine body 1, in injection molding of the magazine body 1 so that the reinforcing metal plates 2 can be more firmly fixed to the upper portion of the magazine body 1. A reinforcing protrusion 221 bending to horizontally protrude outward may be further formed on the body upper-portion reinforcement part 22 to be able to reinforce the body upper-portion reinforcement part 22.

In the magazine according to another embodiment of the present disclosure, a front connection reinforcement plate 24 integrally formed with the body upper-portion reinforcement parts 22 may be further inserted and fixed inside the front plate 11 by insert molding to be able to reinforce the upper portion of the front plate 11 of the magazine body 1 between the front ends of the body upper-portion reinforcement parts 22 of both reinforcing metal plates 2.

A front open groove 241 that is open at both sides and the front and is filled with the synthetic resin for forming of the magazine body 1 may be further formed horizontally at the front ends of the body upper-portion reinforcement parts 22 and the front connection reinforcement plate 24. A magazine front-locking groove 111 in which a locking step (not shown) formed on the front surface of the magazine seat of a riffle is inserted and locked may be further formed horizontally on the outer surface of the front of the synthetic resin filling the front open groove 241. The magazine front-locking groove 111 may have a horizontal locking surface formed at the upper portion thereof, a vertical surface formed under the front of the horizontal locking surface, and an inclined surface inclined forward and downward under the vertical surface.

Therefore, according to the magazine of another embodiment of the present disclosure, the upper portion of the front plate 11 is further reinforced by the front connection reinforcement plate 24, so there is an advantage that deformation of the upper portion of the front plate 11 due to high-temperature heat that is generated when a bullet is fired can be prevented. Further, the durability of the magazine front-locking groove 111 is improved and wear of the magazine front-locking groove 111 is minimized by the front connection reinforcement plate 24, whereby the life span of the magazine can increased as long as possible.

A horizontal rear protrusion 121 may be further formed at the middle portion in the front-rear direction of the rear plate 12 of the magazine body in the magazine according to another embodiment of the present disclosure. A rear connection reinforcement plate 25 inserted and fixed inside the rear plate 12 having the rear protrusion 121 by insert molding may be further integrally formed with the body upper-portion reinforcement part 22 to be able to reinforce the upper portion of the rear plate 12 of the magazine body 1 between the rear ends of the body upper-portion reinforcement parts 22 of both reinforcing metal plates 2.

The rear connection reinforcement plate 25 has inward-bending plates 251 bent inward from the rear ends of both body upper-portion reinforcement parts 22, and a protruding plate 252 protruding outward between the inward-bending plates 251 and inserted and fixed inside the rear protrusion 121. A rear open groove 253 that is open at the rear and both sides open and is filled with the synthetic resin for forming the magazine body 1 is further formed horizontally at the protruding plate 252. Two magazine rear-locking grooves 122 in which two locking steps (not shown) formed at both sides on the rear surface inside the magazine seat of a riffle may be further formed at both sides on the outer surface of the rear of the synthetic resin that fills the rear open groove 253. The magazine rear-locking grooves 122 each may have a horizontal locking surface formed at the upper portion thereof, an inclined surface inclined rearward and downward ahead of the horizontal locking surface so that the magazine can be easily inserted and pulled out.

Therefore, according to the magazine of another embodiment of the present disclosure, the upper portion of the rear plate 12 is further reinforced by the rear connection reinforcement plate 25, so there is an advantage that deformation of the upper portion of the rear plate 12 due to high-temperature heat that is generated when a bullet is fired can be prevented. Further, the durability of the magazine rear-locking grooves 122 is improved and wear of the magazine rear-locking grooves 122 is minimized by the rear connection reinforcement plate 25, whereby the life span of the magazine can increased as long as possible.

Therefore, according to the magazine of another embodiment of the present disclosure, since the reinforcing metal plates 2 are inserted and fixed by insert molding inside the upper portion of the magazine body 1 made of synthetic resin not to be exposed to the outside and the front and rear connection reinforcement plates 24 and 25 are inserted and fixed inside the upper portions of the front and rear plates 11 and 12, deformation of the upper portions of the side plates 13 and the front and rear plates 11 and 12 of the magazine body 1 due to high-temperature heat that is generated when a bullet is fired is maximally prevented. Accordingly, there is an advantage that even though the magazine is used for a long period of time, the magazine can be easily inserted into and pulled out of the magazine seat of a riffle. There is another advantage that even though the magazine is used for a long period of time, a malfunction of separation of the reinforcing metal plates 2 and the front and rear connection reinforcement plates 24 and 25 can be prevented. Further, since deformation of the upper portion of the magazine body 1 due to high-temperature heat that is generated when a bullet is fired is prevented even though a long period of time passes, there is another advantage that it is possible to provide a magazine that can prevent an accidental firing accident when a riffle is fired.

Further, since the reinforcing metal plates 2 and the front and rear connection reinforcement plates 24 and 25 are formed inside the upper portions of the magazine of another embodiment according to the present disclosure by insert molding in the process of manufacturing the magazine through injection molding, two reinforcing metal plates 2 can be inserted and fixed inside the upper portions of the side plates 13 of the magazine body 1 and the guide plates 17 not to be exposed to the outside. Further, the front and rear connection reinforcement plates 24 and 25 can be inserted inside the upper portions of the front and rear plates 11 and 12.

Therefore, according to the magazine of another embodiment according to the present disclosure, since the reinforcing metal plates 2 and the front and rear connection reinforcement plates 24 and 25 are simply inserted and fixed inside the upper portion of the magazine body 1 by insert molding, there is an advantage that it is possible to provide a magazine of which the productivity can be improved and the manufacturing cost can also be reduced.

Although embodiments of the present disclosure were described above, the present disclosure can be achieved by various changes, modifications, and equivalents. It should be understood that the present disclosure can be achieved in other ways by appropriately modifying the embodiment. Therefore, the description does not limit the scope of the present disclosure which is determined by claims.

Meanwhile, although detailed embodiments were described in the detailed description of the present disclosure, it would be apparent to those skilled in the art that the prevent disclosure may be changed in various ways without departing from the scope of the present disclosure.

What is claimed is:

1. A magazine comprising:

a magazine body that is made of synthetic resin, has front and rear plates and two side plates, a cartridge outlet formed at a top thereof, a front groove being open upward and formed at a top of the front plate, and a rear groove being open upward and formed at a top of the rear plate, and has guide plates bent toward the inside of the cartridge outlet at rear portions of top of the side plates and preventing cartridges from separating upward; and two side reinforcing metal plates inserted and fixed by insert molding inside upper end portions of the side plates and the guide plates, the two side reinforcing metal plates not to be exposed to the outside, wherein several resin holes, formed corresponding to the upper end portion of the magazine, filled with the synthetic resin for forming the magazine body are further formed in the reinforcing metal plates, wherein the reinforcing metal plates each have: a guide plate reinforcement part inserted and fixed inside the guide plate; and a transverse body upper-portion reinforcement part integrally connected to a bottom of the guide plate reinforcement part, and elongated and partially or entirely inserted and fixed in a left-right direction inside the upper portion of the side plate, wherein the body upper-portion reinforcement is entirely elongated, inserted, and fixed in the left-right direction inside the upper portions of the side plate;

a front connection reinforcement plate integrally formed with the body upper-portion reinforcement parts is further inserted and fixed inside the front plate by insert molding between front ends of the body upper-portion reinforcement parts of the reinforcing metal plates;

a rear protrusion is further formed vertically at a middle portion in a front-rear direction on the rear plate; and a rear connection reinforcement plate integrally formed with the body upper-portion reinforcement parts is further inserted and fixed inside the rear plate having the rear protrusion by insert molding between rear ends of the body upper-portion reinforcement parts of the reinforcing metal plates.

2. The magazine of claim 1, wherein a reinforcing protrusion bending to horizontally protrude outward is further formed on the body upper-portion reinforcement part.

3. The magazine of claim 1, wherein each of the reinforcing metal plates further has a reinforcing corner plate integrally connecting a front lower portion of the guide plate reinforcement part and a top of the body upper-portion reinforcement part.

4. The magazine of claim 1, wherein a front open groove that is open at both sides and a front and is filled with the synthetic resin for forming of the magazine body is further formed horizontally at the front ends of the body upper-portion reinforcement parts and the front connection reinforcement plate, and a magazine front-locking groove is horizontally formed on an outer surface of a front of the synthetic resin filling the front open groove.

5. The magazine of claim 1, wherein the rear connection reinforcement plate has inward-bending plates bent inward from the rear ends of the body upper-portion reinforcement parts, and a protruding plate protruding outward between the inward-bending plates and inserted and fixed inside the rear protrusion;

a rear open groove that is open at a rear and both sides and is filled with the synthetic resin for forming the magazine body is further formed horizontally at the protruding plate, and two magazine rear-locking grooves are formed at both sides on an outer surface of the rear of the synthetic resin that fills the rear open groove.

* * * * *